US011602210B2

(12) United States Patent
Barrett et al.

(10) Patent No.: US 11,602,210 B2
(45) Date of Patent: Mar. 14, 2023

(54) HOT LATHER DISPENSING DEVICE

(71) Applicant: OneBlade, Inc., Coral Gables, FL (US)

(72) Inventors: Tod Barrett, Golden, CO (US); Gareth Brown, Gardiner, NY (US); Matthew L. Chin, New York, NY (US); Timothy James Elliott, New York, NY (US); Sam Bucciferro, Seymour, CT (US)

(73) Assignee: OneBlade, Inc., Coral Gables, FL (US)

( * ) Notice: Subject to any disclaimer, the term of this patent is extended or adjusted under 35 U.S.C. 154(b) by 97 days.

(21) Appl. No.: 17/183,000

(22) Filed: Feb. 23, 2021

(65) Prior Publication Data

US 2021/0259383 A1 Aug. 26, 2021

Related U.S. Application Data

(60) Provisional application No. 62/980,515, filed on Feb. 24, 2020.

(51) Int. Cl.
*A45D 27/12* (2006.01)
*A47K 5/14* (2006.01)

(52) U.S. Cl.
CPC ..... *A45D 27/12* (2013.01); *A47K 5/14* (2013.01)

(58) Field of Classification Search
CPC ..... A45D 27/12; A45D 27/02; A45D 27/06; A47K 5/14; A47K 5/16; B05B 7/2464; B05B 7/1693; B05B 7/0056; B05B 15/25; B05B 1/30; B01F 23/2464; B01F 23/2351; B01F 27/092; B01F 27/1143
USPC ..... 222/190, 146.2, 146.5
See application file for complete search history.

(56) References Cited

U.S. PATENT DOCUMENTS

| | | | | | |
|---|---|---|---|---|---|
| 2,495,441 | A * | 1/1950 | Campbell | A45D 27/10 | 366/102 |
| 2,925,202 | A * | 2/1960 | Stevens | A45D 27/10 | 239/311 |
| 3,119,779 | A * | 1/1964 | Barrows | C11D 13/00 | 261/DIG. 26 |
| 3,220,954 | A | 11/1965 | Malbe | | |
| 3,335,910 | A | 8/1967 | Rossi | | |
| 3,355,151 | A * | 11/1967 | Menzel | A45D 27/10 | 366/604 |
| 3,498,504 | A | 3/1970 | Wilkins | | |
| 5,544,788 | A * | 8/1996 | Meyer | A47K 5/14 | 222/110 |

(Continued)

FOREIGN PATENT DOCUMENTS

| | | |
|---|---|---|
| JP | S5019695 U | 3/1975 |
| JP | S5257374 U | 4/1977 |
| WO | 2017/081308 A1 | 5/2017 |

OTHER PUBLICATIONS

International Search Report and Written Opinion in Appl. No. PCT/US2021/019167 dated Jun. 4, 2021, 11 pages.

*Primary Examiner* — Lien M Ngo
(74) *Attorney, Agent, or Firm* — Kowert, Hood, Munyon, Rankin & Goetzel, P.C.; Gareth M. Sampson; Dean M. Munyon

(57) ABSTRACT

A hot lather dispenser includes a compartment configured to receive a removable pod, a pump configured to receive liquid from the removeable pod during operation, a heater configured to head the liquid, an auger configured to combine the liquid with air to generate lather, and a nozzle configured to dispense the lather to a user.

18 Claims, 12 Drawing Sheets

(56) References Cited

U.S. PATENT DOCUMENTS

| | | | | |
|---|---|---|---|---|
| 2009/0314806 | A1* | 12/2009 | Ray | B05B 11/3087 222/145.5 |
| 2010/0051642 | A1* | 3/2010 | Wong | B01F 25/4523 222/145.6 |
| 2015/0360187 | A1 | 12/2015 | Varone | |
| 2020/0247604 | A1* | 8/2020 | Cwiok | B05B 7/0018 |

* cited by examiner

HOT LATHER DISPENSING DEVICE

CROSS-REFERENCE TO RELATED APPLICATION

The present application claims the benefit of U.S. Provisional Appl. No. 62/980,515 filed on Feb. 24, 2020; which is incorporated by reference herein in its entirety.

BACKGROUND

Technical Field

This disclosure relates generally to lather dispensing devices.

Description of the Related Art

Devices used to aerate liquid into a foam or lather can be used for many applications including shaving and cleaning surfaces. Liquid may be kept in a reservoir, aerated into a lather using an electric motor, and dispensed to the user. The liquid may also be heated before being aerated into lather.

Figure 1:
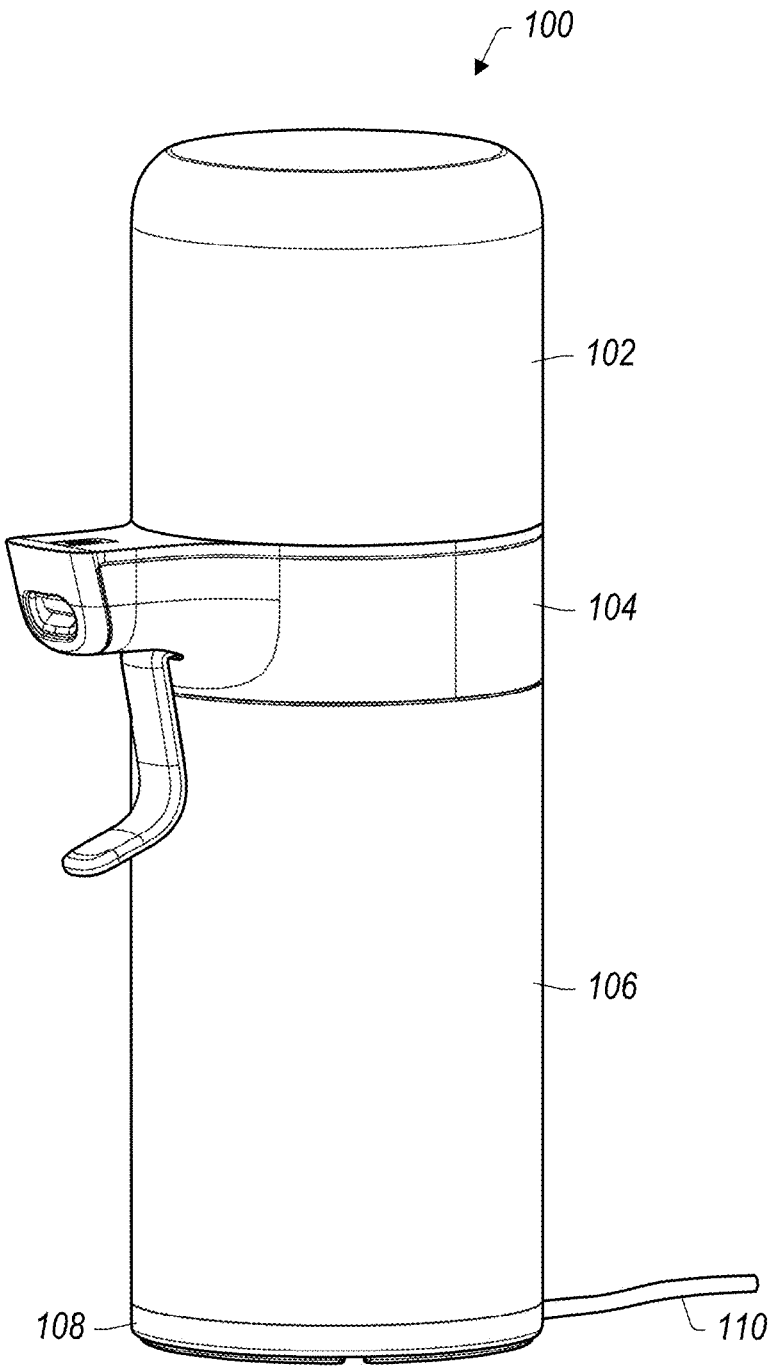
FIG. 1 is a diagram illustrating a perspective view of an assembled hot lather dispensing device.

This disclosure includes references to "one embodiment" or "an embodiment." The appearances of the phrases "in one embodiment" or "in an embodiment" do not necessarily refer to the same embodiment. Particular features, structures, or characteristics may be combined in any suitable manner consistent with this disclosure.

Within this disclosure, different entities (which may variously be referred to as "units," "circuits," other components, etc.) may be described or claimed as "configured" to perform one or more tasks or operations. This formulation—[entity] configured to [perform one or more tasks]—is used herein to refer to structure (i.e., something physical, such as an electronic circuit). More specifically, this formulation is used to indicate that this structure is arranged to perform the one or more tasks during operation. A structure can be said to be "configured to" perform some task even if the structure is not currently being operated. A "computer system configured to control a pump" is intended to cover, for example, a computer system has circuitry that performs this function during operation, even if the computer system in question is not currently being used (e.g., a power supply is not connected to it). Thus, an entity described or recited as "configured to" perform some task refers to something physical, such as a device, circuit, memory storing program instructions executable to implement the task, etc. This phrase is not used herein to refer to something intangible. Thus, the "configured to" construct is not used herein to refer to a software entity such as an application programming interface (API).

Reciting in the appended claims that a structure is "configured to" perform one or more tasks is expressly intended not to invoke 35 U.S.C. § 112(f) for that claim element. Accordingly, none of the claims in this application as filed are intended to be interpreted as having means-plus-function elements. Should Applicant wish to invoke Section 112(f) during prosecution, it will recite claim elements using the "means for" [performing a function] construct.

As used herein, the terms "first," "second," etc. are used as labels for nouns that they precede, and do not imply any type of ordering (e.g., spatial, temporal, logical, etc.) unless specifically stated. For example, references to "first" and "second" pins would not imply an ordering between the two unless otherwise stated.

As used herein, the term "based on" is used to describe one or more factors that affect a determination. This term does not foreclose the possibility that additional factors may affect a determination. That is, a determination may be solely based on specified factors or based on the specified factors as well as other, unspecified factors. Consider the phrase "determine A based on B." This phrase specifies that B is a factor is used to determine A or that affects the determination of A. This phrase does not foreclose that the determination of A may also be based on some other factor, such as C. This phrase is also intended to cover an embodiment in which A is determined based solely on B. As used herein, the phrase "based on" is thus synonymous with the phrase "based at least in part on."

It is to be understood the present disclosure is not limited to particular devices or methods, which may, of course, vary. It is also to be understood that the terminology used herein is for the purpose of describing particular embodiments only, and is not intended to be limiting. As used herein, the singular forms "a", "an", and "the" include singular and plural referents unless the content clearly dictates otherwise. Furthermore, the words "can" and "may" are used throughout this application in a permissive sense (i.e., having the potential to, being able to), not in a mandatory sense (i.e., must). The term "include," and derivations thereof, mean "including, but not limited to." The term "coupled" means directly or indirectly connected.

DETAILED DESCRIPTION

Dispensers of hot lather can enable the user have a more pleasant shaving experience. Rather than use an aerosol-dispensed shaving foam from a can or shaving soap that is manually aerated with a brush, a user can easily dispense a desired amount of lather at a preferred temperature. While prior dispensers have been used in barbershops and salons, such dispensers suffer a number of drawbacks that make them unsuited for use at home. Unlike a hot lather dispenser that is used repeatedly over the course of a day in a barbershop or salon, a hot lather dispenser used in a home setting is unlikely to be used as frequently (e.g., once a day when the user shaves in the morning). Additionally, prior dispensers were less concerned with keeping the shaving liquid from spoiling (e.g., losing moisture) and were less concerned about clogs (e.g., because clogs were less likely to occur because liquid passed through the dispenser more frequently) because the shaving liquid was likely to be used repeatedly throughout the day and consumed relatively quickly (e.g., over the course of a day). Additionally, because a dispenser used in a barbershop or salon is used much more frequently, such dispensers are configured to use much more electrical power to ensure that larger amounts of hot lather can be dispensed. In order to design a hot lather dispenser suited for less frequent use (e.g., use in a home setting), the inventors of this disclosure have designed a hot lather dispenser that (a) prevents spoilage of unused portions of shaving liquid and (b) uses less electrical power.

Figure 2:
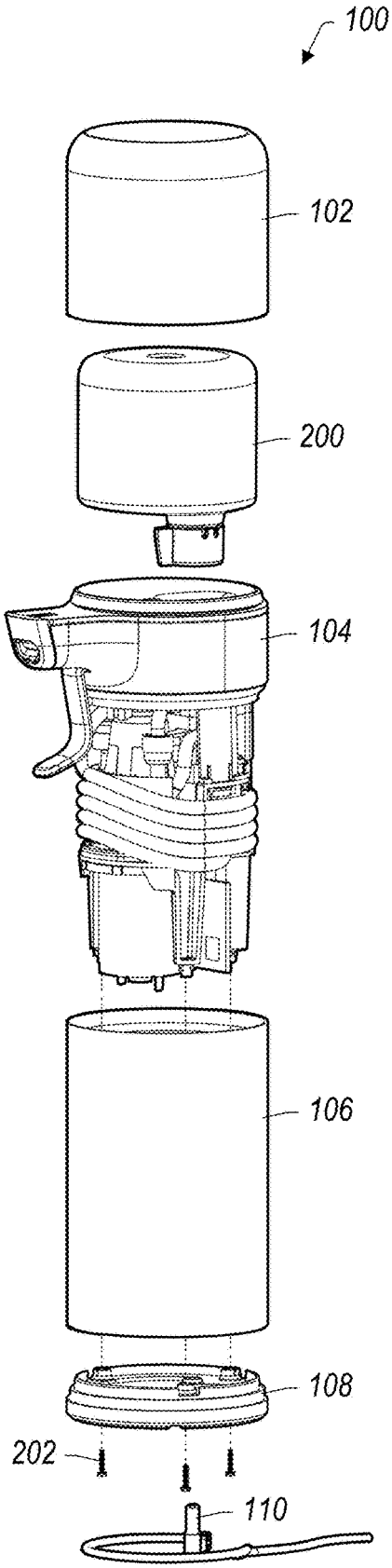
FIG. 2 is a diagram illustrating a partially exploded perspective view of the hot lather dispensing device of FIG. 1 including a pod subassembly and an internal subassembly in accordance with various embodiments.

Referring now to FIGS. 1-10, various embodiments of a hot lather dispenser 100 and components thereof are illustrated. FIGS. 1 and 2 illustrate a perspective view of an assembled dispenser 100 and a partially exploded perspective view of a dispenser 100 showing various components. As shown in FIG. 1, dispenser 100 includes a cover 102, an internal subassembly 104, a cylinder 106, a foot subassembly 108, and a cord 110. As shown in FIG. 2, cover 102 fits over a pod subassembly 200 (also referred to herein as a pod) which in turn seats in internal subassembly 104. Internal subassembly 104 in turn seats within cylinder 106. In various embodiments, cylinder 106 is double-walled, enabling improved heat retention over a single-walled cylinder. Foot subassembly 108 is secured to the bottom of dispenser 100 via a plurality of screws 202. In the embodiment shown, electrical power is suppled to dispenser 100 via cord 110. In other embodiments, however, electrical power may be supplied by one or more batteries in addition to or as alternative to cord 110. In some embodiments, cord 110 is coupled to one or more batteries, enabling charging of such batteries. Pod subassembly 200 and its components are discussed in further detail in reference to FIGS. 3A-3D. Internal subassembly 104 and its components are discussed in further detail in reference to FIGS. 4-11. While only a single internal subassembly 104 and pod subassembly 200 are shown in FIGS. 1-11, it will be understood that more than one could be present in various configurations (e.g., two pod subassemblies inserted into respective internal subassemblies 104 with a cover 102 that encloses both of each). In various embodiments having two or more pod subassemblies 200, the various pod subassemblies may contain different liquids (e.g., shaving soap and facial cleansing soap).

In various embodiments, using a double-walled, insulated configuration facilitates heat retention, which can contribute to power reduction and facilitate maintaining dispensed material at a consistent output temperature. Reduced power requirements facilitate the use of a lower-voltage power supply, such as a 12-volt supply and/or batteries in contrast to typical 110/220-volt supplies. This in turn helps reduce electrical shock risk, particularly in wet environments such as bathrooms, kitchens, or the like. Additionally, as discussed in further detail in FIGS. 3A-3D, 5, 7A, 7B, 8A, 8B, 9A, and 9B, through the use of pod subassembly 200 and internal subassembly 104, only a small amount of liquid is drawn from pod subassembly 200 at a time, which allows the remaining liquid to be kept from spoilage inside pod subassembly 200. Further, as discussed herein, the small amount of liquid that is drawn from pod subassembly 200 but is not dispensed is able to be kept within a sealed portion of internal subassembly 104, which enables prevention of spoilage of this amount of liquid as well.

Figure 3A:
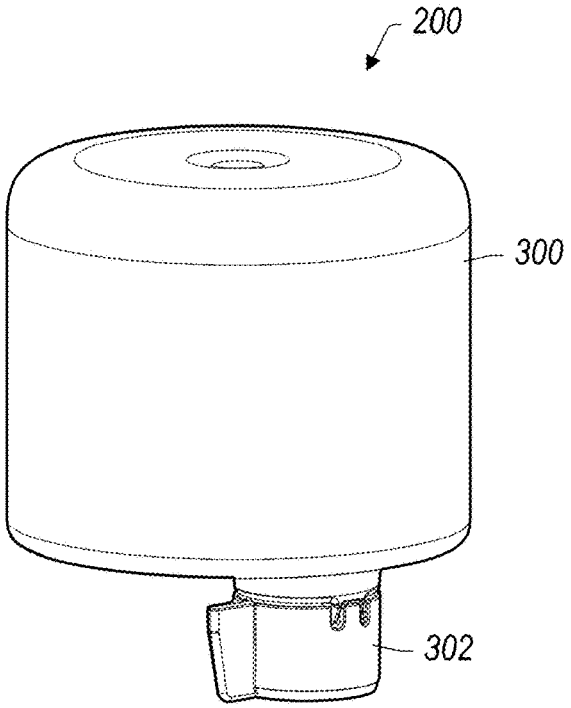
FIGS. 3A, 3B, 3C, and 3D are various views of the pod subassembly of FIG. 2.
Figure 3B:
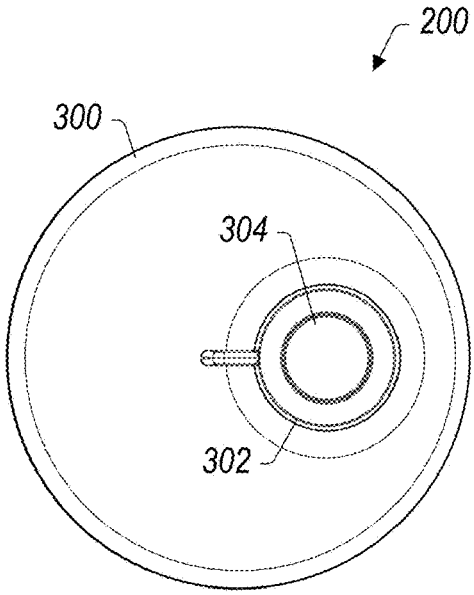
Figure 3C:
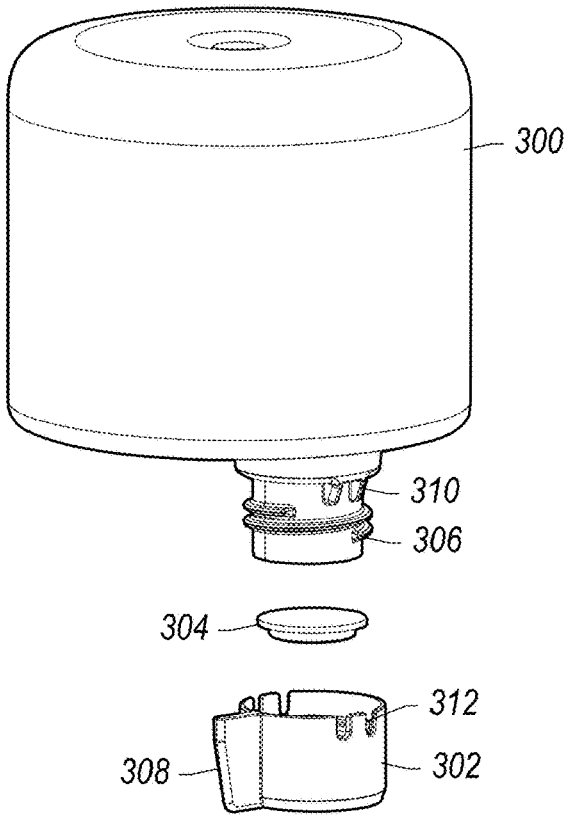
Figure 3D:
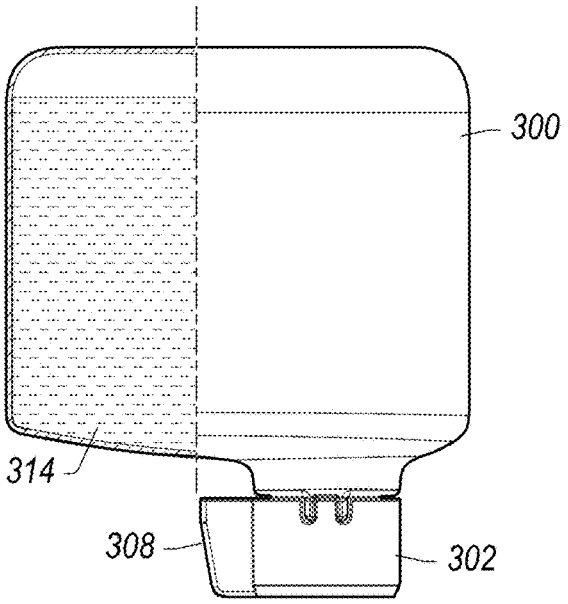

Referring now to FIGS. 3A, 3B, 3C, and 3D, various views of pod subassembly 200 are illustrated in greater detail. FIG. 3A illustrates a perspective view of pod subassembly 200, FIG. 3B illustrates a bottom view of pod subassembly 200, FIG. 3C illustrates an exploded view of pod subassembly 200, and FIG. 3D illustrates a partial cutaway view of pod subassembly 200. As shown here, a pod container 300 is filled with a liquid 314 and is sealed by a membrane 304 that, prior to insertion into dispenser 100, may be covered by a cap 302. In various embodiments, pod container 300 is transparent or translucent, which enables liquid 314 to be visible through pod container 300. In various embodiments, cap 302 include a locator fin 308 that is configured to ensure proper alignment with dispenser (e.g., by fitting in a corresponding slot in internal subassembly 104). Upon insertion of pod subassembly 200 into dispenser 100, membrane 304 may be pierced by one or more hollow needles (e.g., needles 443 shown in FIG. 4) to facilitate the flow of liquid 314 into dispenser 100. In various embodiments, membrane 304 is made of silicone or any other suitable material. Liquid 314 may be, for example, a soap solution formulated to produce lather when processed by dispenser 100. In some embodiments, liquid 314 may be formulated for skin care applications, such as shaving and/or washing. In other embodiments, liquid 314 may be formulated for other applications, such as cleaning of hard surfaces.

While some liquid 314 formulations may be optimized to produce lather for shaving applications, other formulations may be produced for other applications. For example, liquid 314 may be formulated to produce lather for general skin cleansing such as hand and/or body washing, makeup removal, or other applications. The use of heated cleansing lather may facilitate cleansing efficacy while reducing or eliminating dependence on chemical detergents or other substances that can cause skin damage, swelling, or other types of injury.

Referring briefly back to FIGS. 1 and 2, in some embodiments, cover 102 is transparent in a manner that permits pod container 300 to be visible from the exterior of the dispenser. This facilitates display of any branding or messaging that appears on pod container 300, enabling the user to quickly identify what type of pod is installed at any given time. Such transparency may also enable the user to view the volume of liquid 314 remaining within pod container 300.

Referring back to FIGS. 3A-3D, in various embodiments, cap 302 is secured to a threaded neck 306 of pod container 300. In such embodiments, threaded neck 306 includes a threaded surface that interfaces with a corresponding threaded surface in cap 302. In some embodiments, pod container 300 includes one or more anti-rotation features 310 and cap 302 includes one or more corresponding slots 312. When cap 302 is installed, membrane 304 is secure against threaded neck 306 and the one or more anti-rotation features 310 are disposed within the corresponding slots 312, preventing rotation of cap 302. Preventing rotation locks locator fin 308 in the correct position and prevents users from refilling pod container 300. As used herein, a "means for containing liquid" refers to pod subassembly 200 and its equivalents. "Means for containing liquid" refers to embodiments in which pod container 300 contains any of a number of different liquids 314 and is not limited to liquid 314 used to produce shaving lather. "Means for containing liquid" also refers to embodiments in which pod container 300 is opaque, translucent, or transparent. "Means for containing liquid" also includes embodiments in which the anti-rotation features 310 and corresponding slots 312 are not present.

Figure 4:
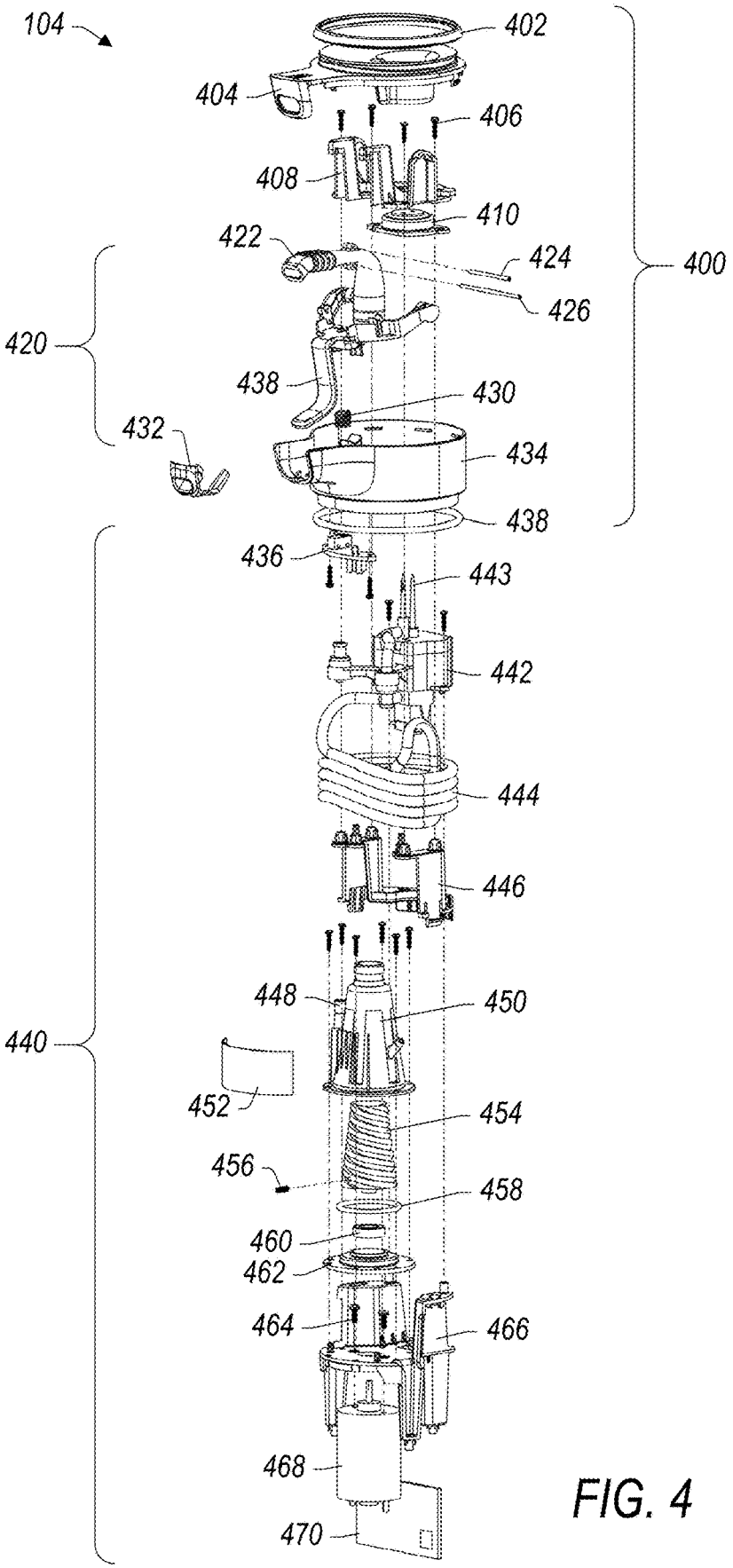
FIG. 4 is a partially exploded perspective view of the internal subassembly of FIG. 2 in accordance with various embodiments.

Referring now to FIG. 4, an exploded perspective view of internal subassembly 104 is illustrated. Internal subassembly 104 includes a pod interface subassembly 400, a spout subassembly 420, and a heating and lather (HL) subassembly 440. Pod interface subassembly 400 is configured to receive pod subassembly 200 (e.g., by receiving cap 302, threaded neck 306, and membrane 304 within a compartment formed by pod interface subassembly 400 and/or by supporting a bottom surface of pod subassembly 200 on a top surface of pod interface subassembly 400). Pod interface subassembly 400 is also configured, in various embodiments, to couple to cover 102 when it is positioned over pod subassembly 200. Thus, pod interface subassembly 400 enables pod subassembly 200 it to be held within dispenser 100. At the top of pod interface subassembly 400, a spout lid 404 with gasket 402 is provided for interfacing with an inserted pod subassembly 200. A gasket 410 is provided through which protruding needles 443 can pierce an inserted pod subassembly 200 (e.g., by piercing membrane 304) to facilitate the flow of pod subassembly 200 contents (e.g., liquid 314) into dispenser 100. While two needles 443 are shown in FIG. 4, in various embodiments, different numbers may be present (e.g., 1, 3, 4, etc.). In various embodiments, liquid 314 flows out of pod subassembly 200 through one of the needles 443 and air flows into pod subassembly 200 through another of the needles 443. A bracket 408 is provided for supporting, within spout compartment 434, spout subassembly 420 through which lather is dispensed. An O-ring 438 seals internal subassembly 104 against cylinder 106.

In the illustrated embodiment, spout subassembly 420 includes lather tube 422, trigger subassembly 428, top retaining pin 424, bottom retaining pin 426, spring 430, and spout nozzle 432. In various embodiments, spout subassembly 420 is configured to permit single-handed dispenser operation. As illustrated in greater detail in FIGS. 6A and 6B, top retaining pin 424 and bottom retaining pin 426 are configured to interact with trigger subassembly 428 to pinch lather tube 422 closed (via the force of spring 430) when the trigger is not engaged, and to open when the trigger is engaged to permit the flow of lather through lather tube 422 to spout nozzle 432. It is noted that in various embodiments, this mechanical approach to physically opening and closing lather tube 422 obviates the need for complex and expensive motion-sensing devices for dispenser activation, while helping to seal lather tube 422 against air ingress, leakage, and evaporation. Spout subassembly 420 is discussed in greater detail in reference to FIGS. 6A, 6B, and 7.

HL subassembly 440 is disposed within cylinder 106 and is configured to draw liquid 314 from pod subassembly 200, heat it, and process the liquid into lather to be dispensed through spout subassembly 420. A pump subassembly 442 (also referred to herein as a pump), when activated by trigger subassembly 428, draws liquid 314 from the inserted pod subassembly 200 and pumps it through auger tubing 444, which coils around bracket 446 and auger chamber 450. A heating element 452 (also referred to herein as a heater) is located in between auger tubing 444 and auger chamber 450, although in other embodiments it may be configured differently. Within auger chamber 450, an auger 454 is configured to spin when driven by auger motor 468. When activated, auger 454 receives liquid via auger tubing 444 and air via auger air inlet 448, and mixes air with the liquid to create lather which is forced out the top of auger chamber 450 and into lather tube 422 for dispensing. Auger 454 is held withing auger chamber 450 by chamber bottom 462. A rotary seal 460 and O-ring 458 prevents liquid from exiting auger chamber 450, and the rotor of auger motor 468 is secured within auger 454 using set screw 456. Chamber bottom 462, auger 454, and auger chamber 450 are disposed over bracket 466, and auger motor 468 is secured to bracket 466 by a plurality of screws 464. The flow of liquid from pod subassembly 200 through internal subassembly 104 is discussed in further detail in reference to FIGS. 5, 8A, and 8B. An alternative embodiment of HL subassembly 440 (also referred to as subassembly 900) that does not include auger tubing 444 and bracket 446 and is configured to employ an alternative flow of liquid from pod subassembly 200 through internal subassembly 104 is discussed in reference to FIGS. 9A and 9B. Auger 454 and auger chamber 450 are discussed in further detail in reference to FIGS. 10 and 11.

Printed circuit board assemblies 436 and 470 include electronics that control the operation of various components of dispenser 100. For example, in various embodiments, printed circuit board assembly 436 includes circuitry configured to detect when trigger subassembly 428 is engaged and to control pump subassembly 442 and printed circuit board assembly 470 includes circuitry configured to control auger motor 468 and heating element 452. In various embodiments, printed circuit board assemblies 436 and 470 are coupled together by one or more wires. In a particular embodiment, heating element 452 remains on at a low level of output whenever power is supplied to dispenser 100 but trigger subassembly 428 is not engaged, in order to maintain the temperature of liquid within auger tubing 444 (or alternative auger chamber 950 shown in FIGS. 9A and 9B) at a dispensing temperature (e.g., 120° F.) without necessarily heating the entire volume of liquid within the dispenser (e.g., the volume in a reservoir associated with pump subassembly 442 and/or pod subassembly 200) to this temperature. By targeting the output of heating element 452 to a limited volume of liquid that is positioned to be immediately dispensed, the overall power requirements of the dispenser may be significantly reduced.

Figure 12:
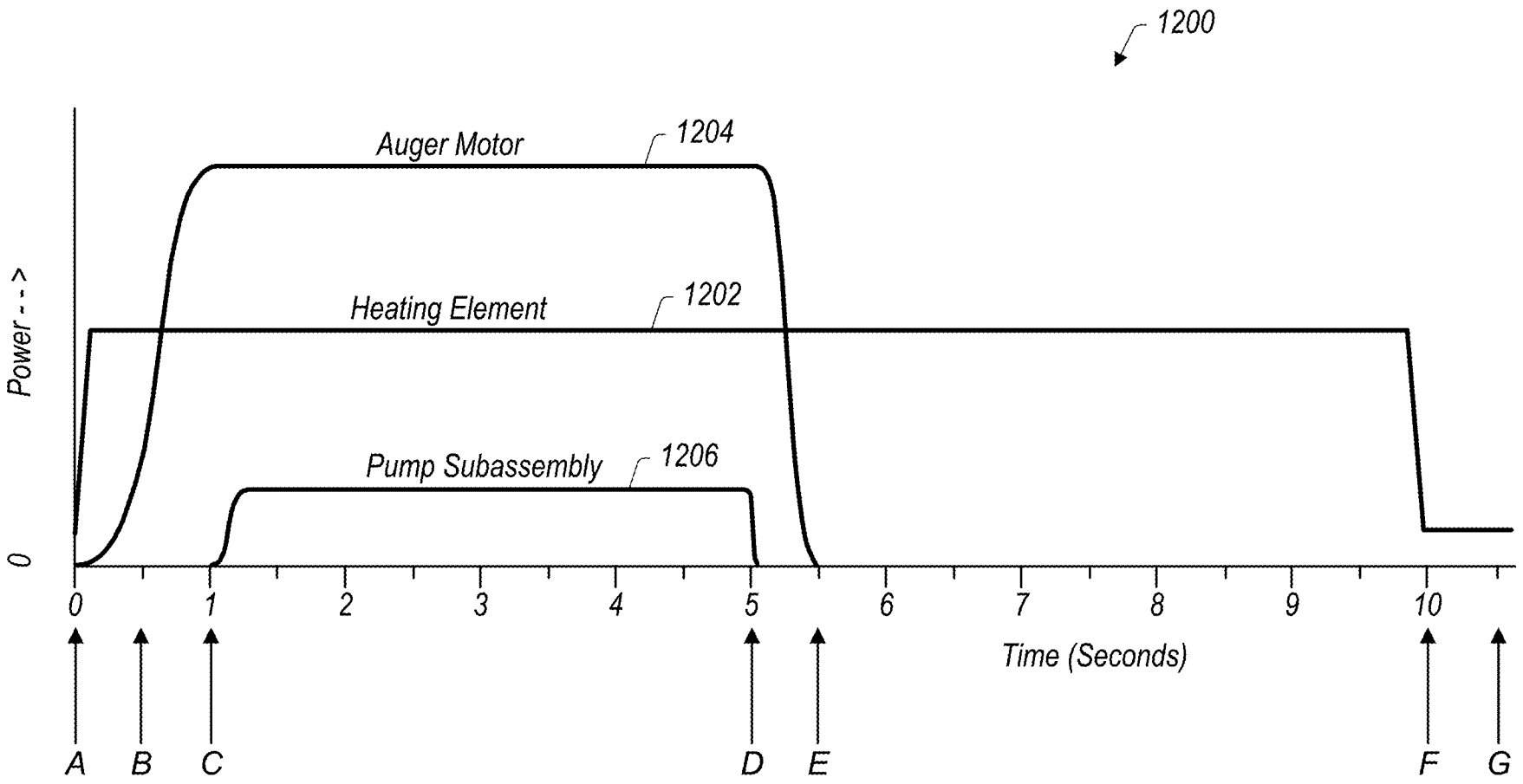
FIG. 12 is a graph showing power usage over time of various components of the hot lather dispensing device of FIG. 1 in accordance with various embodiments.

When trigger subassembly 428 is engaged, heating element 452 may first be activated at a higher or peak level of power relative to its standby output. Auger motor 468 may be gradually activated to its full operating speed over a period of time (e.g., 1 second) after which pump subassembly 442 may be activated. At this higher level of power, heating element 452 is configured to heat cooler liquid 314 entering auger tubing 444 (or alternative auger chamber 950 shown in FIGS. 9A and 9B) as preheated liquid is dispensed. When dispensing is complete and trigger subassembly 428 is released, pump subassembly 442 may be stopped before auger motor 468 (e.g., 0.5 second before). However, in some embodiments, heating element 31 may remain activated for a period of time (e.g., 5-60 seconds in various embodiments, which may be user-configurable) before returning to its standby output. This may improve performance when a user successively activates trigger subassembly 428 multiple times turning a relatively short interval. A chart illustrating a timeline of the operation of various components of HL subassembly 440 is shown in FIG. 12 discussed in further detail below.

Figure 9B:
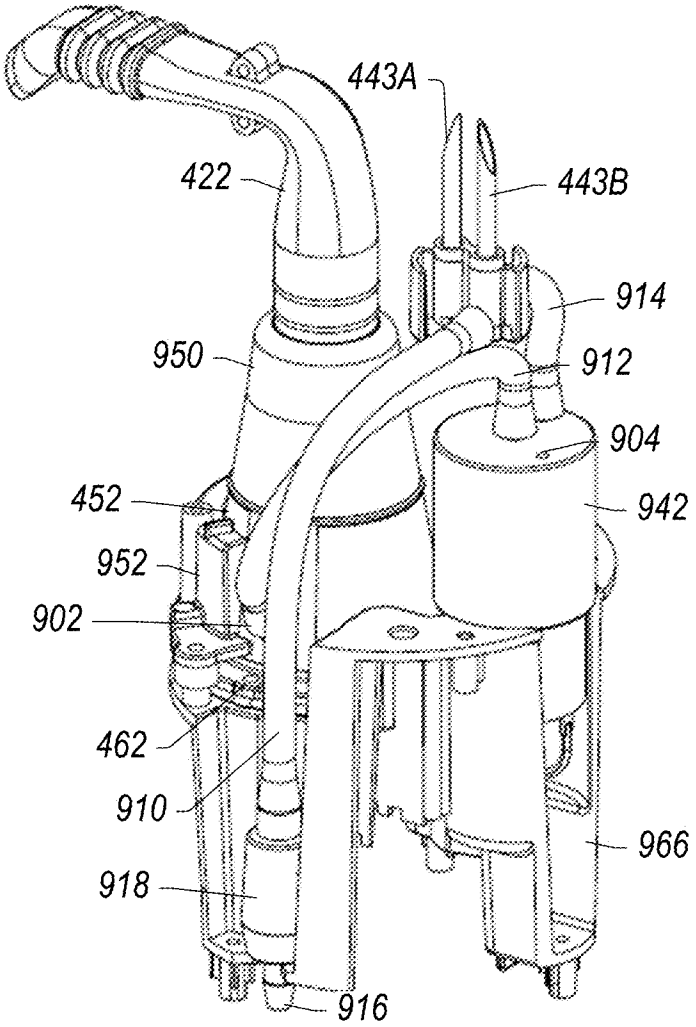
FIGS. 9A and 9B are various views of an alternate auger subassembly in according with various embodiments.
Figure 9A:
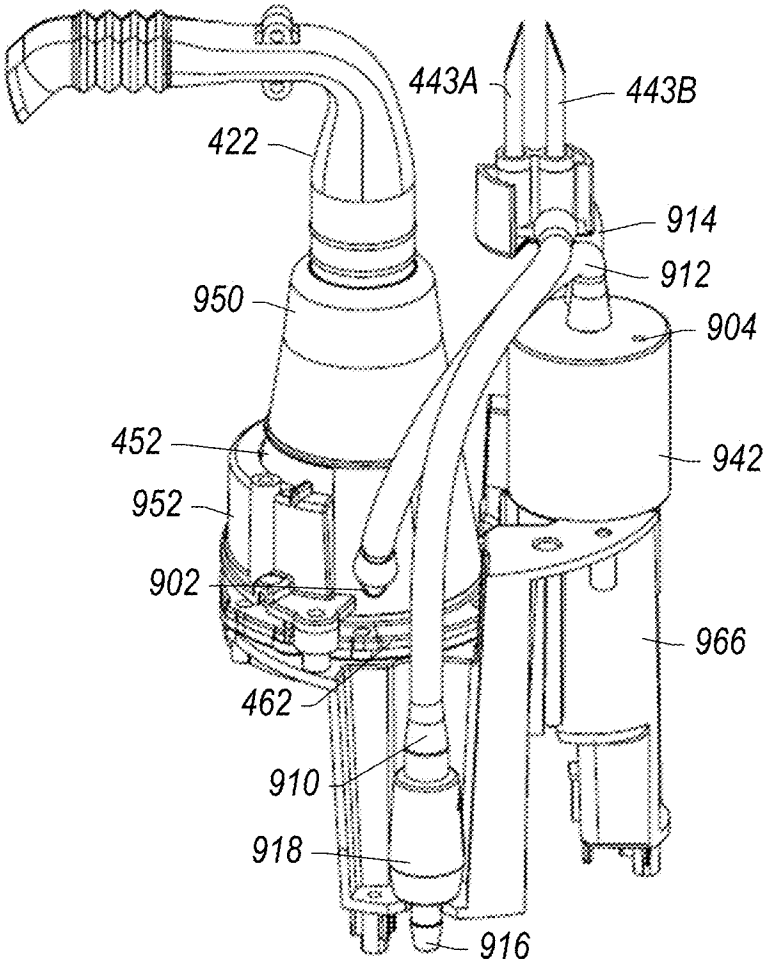

The configuration of auger 454 and auger chamber 450 (the discussion of auger chamber 450 in this paragraph also applies to alternative auger chamber 950 shown in FIGS. 9A and 9B) contributes significantly to the performance of dispenser 100. For example, the taper of auger 454 as well as its dimensions and the configuration of its splines, as well as the interaction of auger splines with auger chamber 450, affect bubble size and resultant lather characteristics such as density. Lather characteristics may also be modulated during use by varying the spin rate of auger 454 in conjunction with the rate of fluid flow into auger chamber 450. Additional details regarding embodiments of auger 454 and auger chamber 450 are discussed herein in reference to FIGS. 10 and 11. As used herein, a "means for processing liquid into lather" refers to internal subassembly 104 and its equivalents. As used herein, a "means for heating and aerating liquid" refers to HL subassembly 440 and its equivalents. Both the "means for processing liquid into lather" and "means for heating and aerating liquid" include various configurations of auger 254 and auger chamber 450/alternative auger chamber 950 discussed herein. Both the "means for processing liquid into lather" and "means for heating and aerating liquid" also include subassembly 900 discussed in reference to FIGS. 9A and 9B. Additionally, "means for processing liquid into lather" and "means for heating and aerating liquid" include different configurations of auger tubing 444 (e.g., more coils around auger chamber 450, fewer coils around auger chamber 450, flat tubing instead of the round tubing illustrated herein) and the tubes 910, 912, and 914 shown in FIGS. 9A and 9B.

Figure 5:
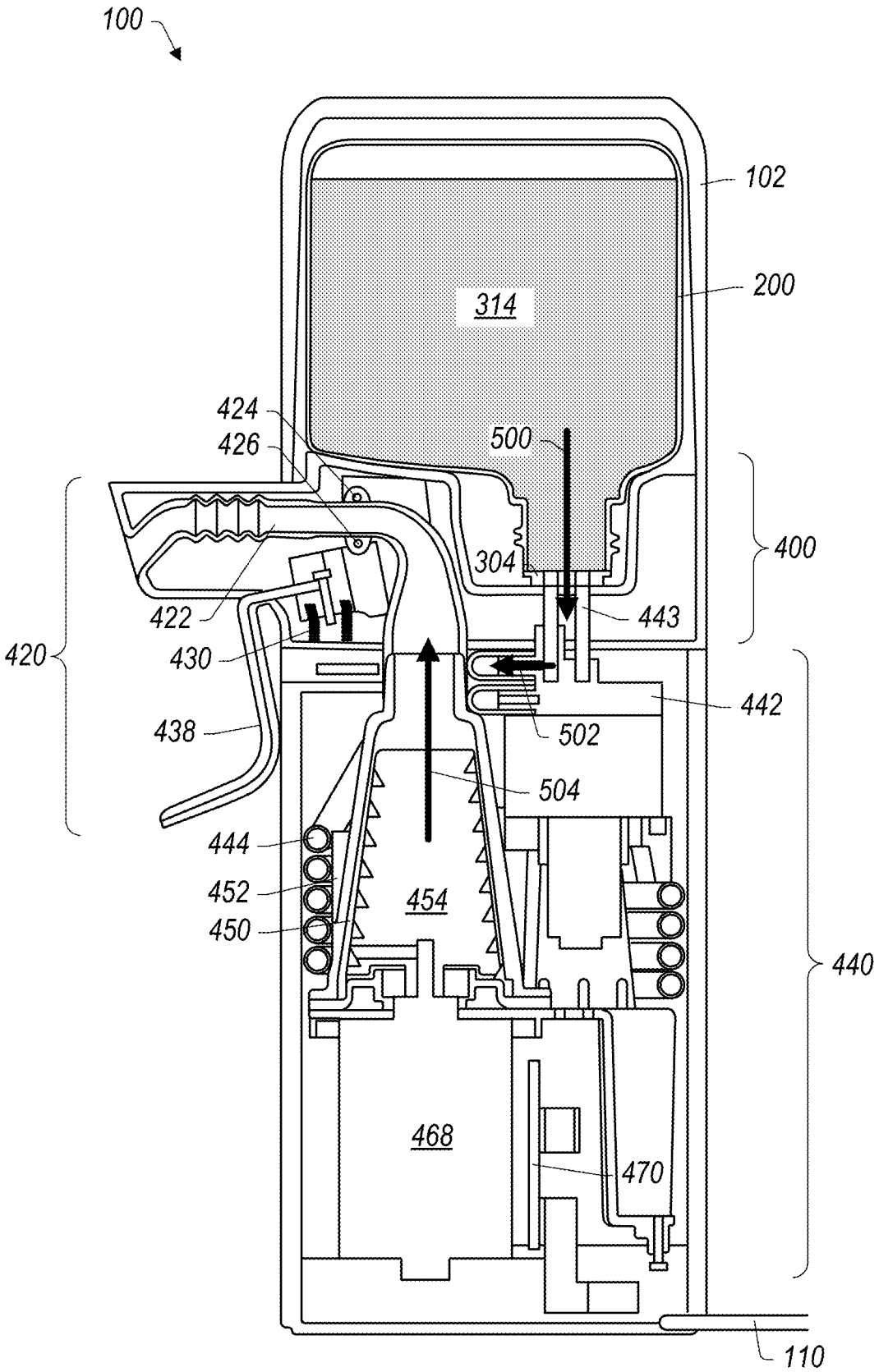
FIG. 5 is a cutaway sideview of the hot lather dispensing device of FIG. 1 in accordance with various embodiments.

Referring now to FIG. 5, a cutaway view of dispenser 100 is illustrated. FIG. 5 illustrates the flow of liquid 314 from pod subassembly 200 through membrane 304 and into pod interface subassembly 400 via needles 443 (arrow 500), into HL subassembly 440 (arrow 502), and vertically through auger chamber 405 and into a spout subassembly 420 (arrow 504) for dispensing to the user. As discussed herein, pump subassembly 442, when activated by trigger subassembly 428, draws liquid 314 from the inserted pod subassembly 200 and pumps it through auger tubing 444, which coils around auger chamber 450. Liquid 314 is then heated and pumped into auger chamber 450 and is mixed with air by auger 454 to form a lather. The heated lather is then dispensed out of spout subassembly 420.

It is noted that the vertical configuration of the dispenser shown in FIGS. 1-5 may confer several advantages. Conventional lather dispensers are configured in a horizontal orientation that consumes considerably more area than the vertical configuration of the dispenser discussed here. This in turn reduces the amount of room occupied by the dispenser, making it easier to accommodate particularly for home use (as opposed to commercial devices found in barbershops and hair salons).

Additionally, employing a vertical auger design enables un-foamed solution to drain back down into auger chamber 450 to be re-foamed rather than being dispensed as liquid. This may facilitate device hygiene by decreasing the likelihood of bacterial growth within the liquid during the heating and foaming process. Hygiene may further be facilitated by the use of pod subassembly 200: water quality and sterility can be verified at the time of pod subassembly 200 manufacturing, and the use of sealed, premanufactured pod subassemblies 200 in combination with an essentially closed system between subassembly 200 and spout subassembly 420 provides few points for entry of contaminants. This in turn may permit the formulation of pods with few or no preservatives to inhibit microbial growth.

Additionally, in various embodiments, an air check valve (e.g., positioned over auger air inlet 448) may be employed to permit the necessary degree of air infiltration into auger chamber 450 for foaming to occur, but which prevent evaporation of liquid from within the auger chamber. Similarly, an air check value may be used at the pump subassembly 442 so that air enters the reservoir of this subassembly only as liquid is pumped out, rather than being free to circulate into and out of the reservoir. Collectively, the use of air check valves facilitates the reduction of evaporation and clog formation within the dispenser. Additionally, as noted above with respect to FIG. 4 and illustrated in FIGS. 6A and 6B below, lather tube 422 may be pinched closed while the dispenser is not in use, further preventing the ingress of air into the system and evaporation via the spout nozzle 432. In contrast, conventional lather devices employ open tubes at their nozzles, which are prone to evaporation and clogging.

It is noted that conventional lather dispensers often employ gravity-fed drip valves for supplying liquid to the foaming chamber. Such approaches may require periodic cleaning and be prone to clogs. By contrast, the powered approach of pumping fluid into the auger as discussed above tends to improve reliability.

Figure 6A:
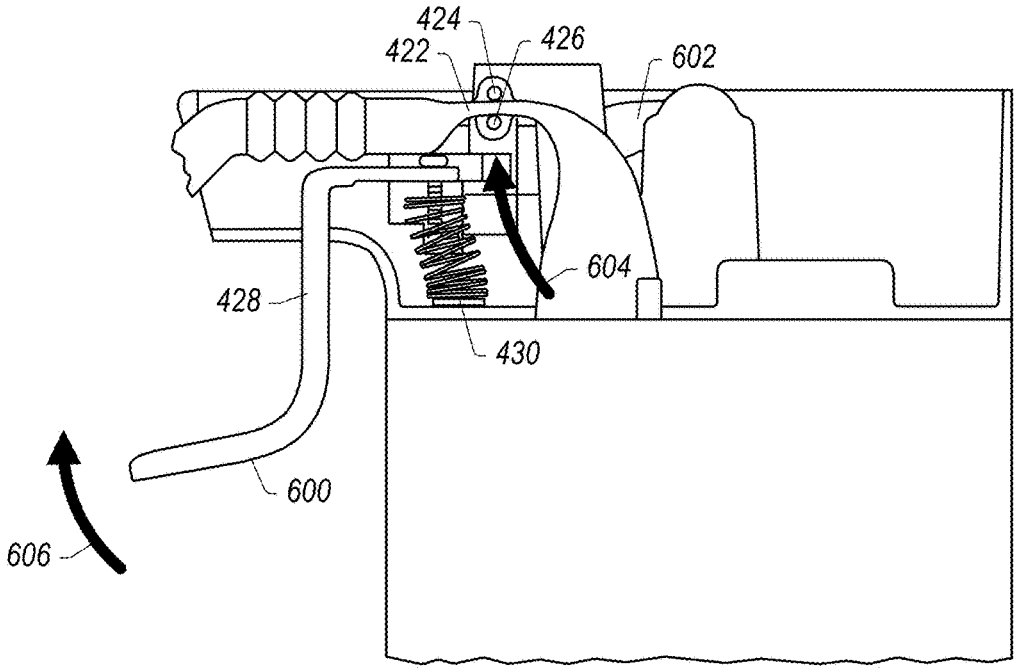
FIGS. 6A and 6B are cutaway sideviews of the trigger subassembly of FIG. 4 in accordance with various embodiments.
Figure 6B:
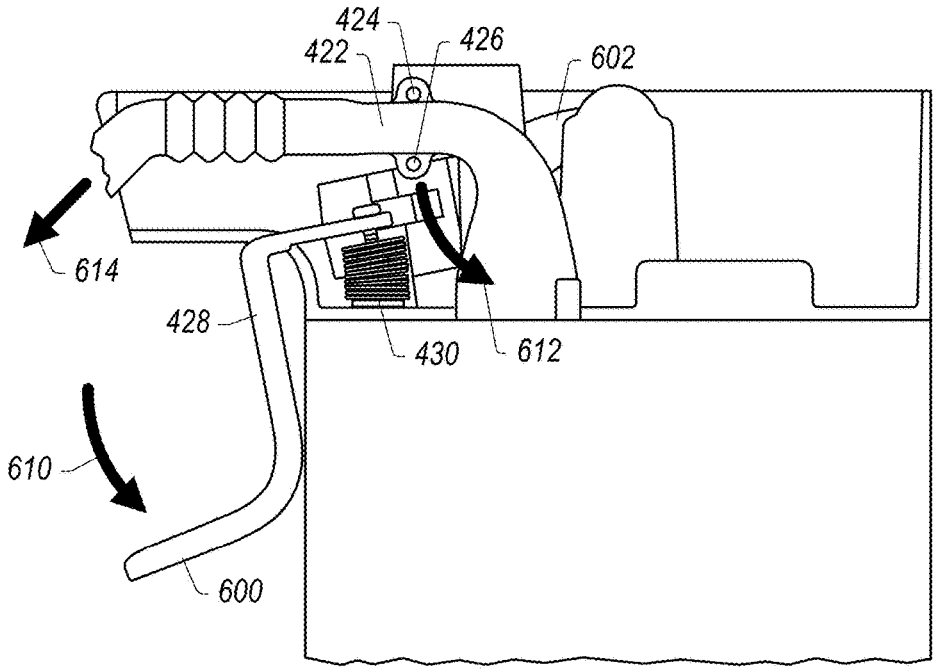
Figure 7:
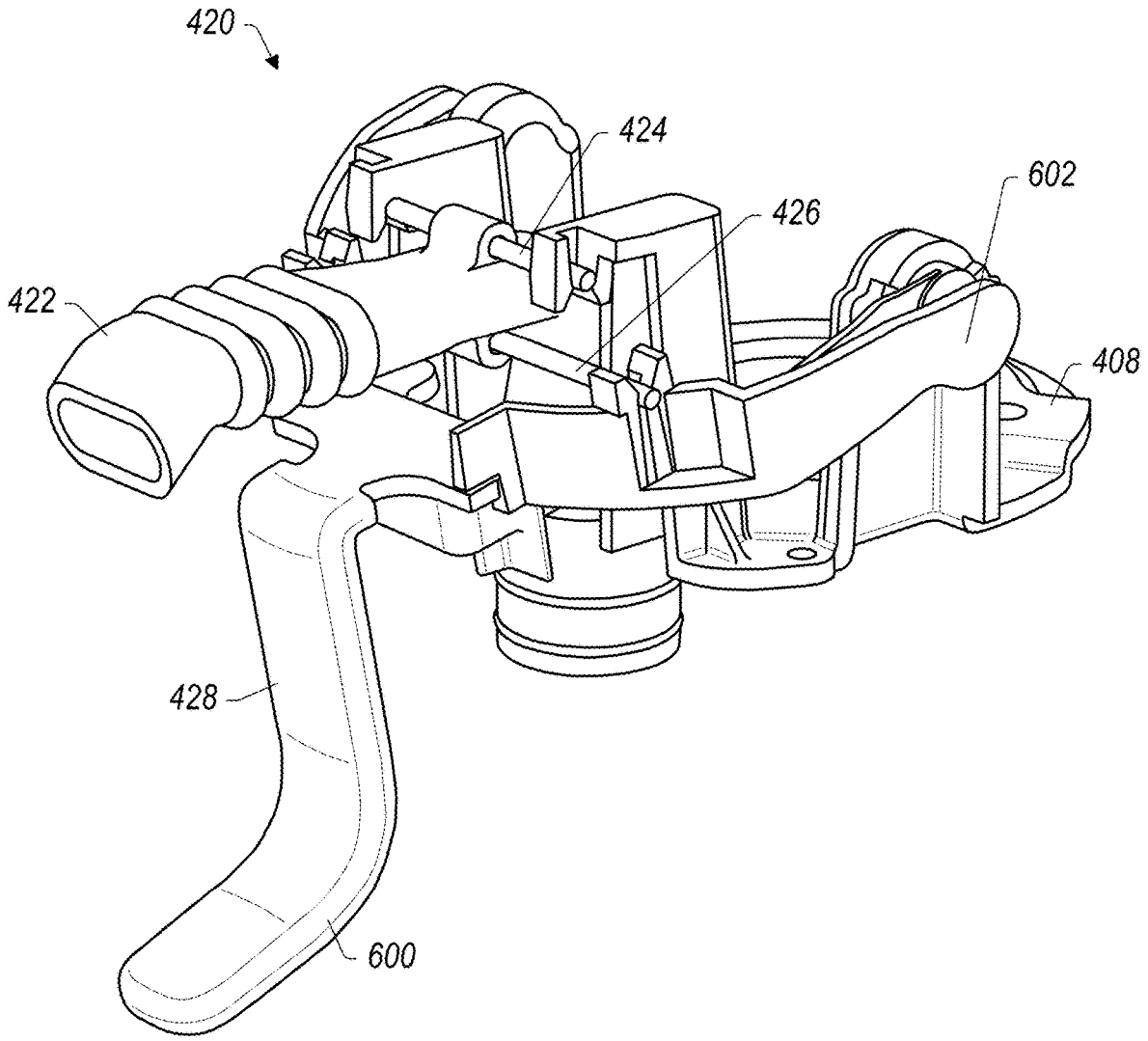
FIG. 7 is a perspective view of the trigger subassembly of FIG. 4 in accordance with various embodiments.

Referring now to FIGS. 6A and 6B, cutaway sideviews of spout subassembly 420 are shown with lather tube 422 pinched closed and open, respectively. As shown in FIG. 6A, spring 430 is in an uncompressed state and biasing trigger subassembly 428 into the closed position. When trigger subassembly 428 is in the closed position, spring 430 exerts force (illustrated by arrow 604) on the interior portion 602 of trigger subassembly 428 that is disposed within dispenser 100, pushing interior portion 602 up, causing lather tube 422 to be pinched closed between top retaining pin 424 and bottom retaining pin 426. The exterior portion 600 of trigger subassembly 428 is likewise pushed away from dispenser 100 (illustrated by arrow 606). As shown in FIG. 6B, a force 610 (e.g., from a user) depresses the exterior portion 600, pushing it closer to dispenser 100. As a result, spring 430 is compressed by the opposing force (illustrated by arrow 612), and bottom retaining pin 426 is pulled away from top retaining pin 424 and unpinching lather tube 422 such that lather can be dispensed (illustrated by arrow 614). Referring now to FIG. 7, a perspective view of spout subassembly 420 in the open position is shown.

Figure 8A:
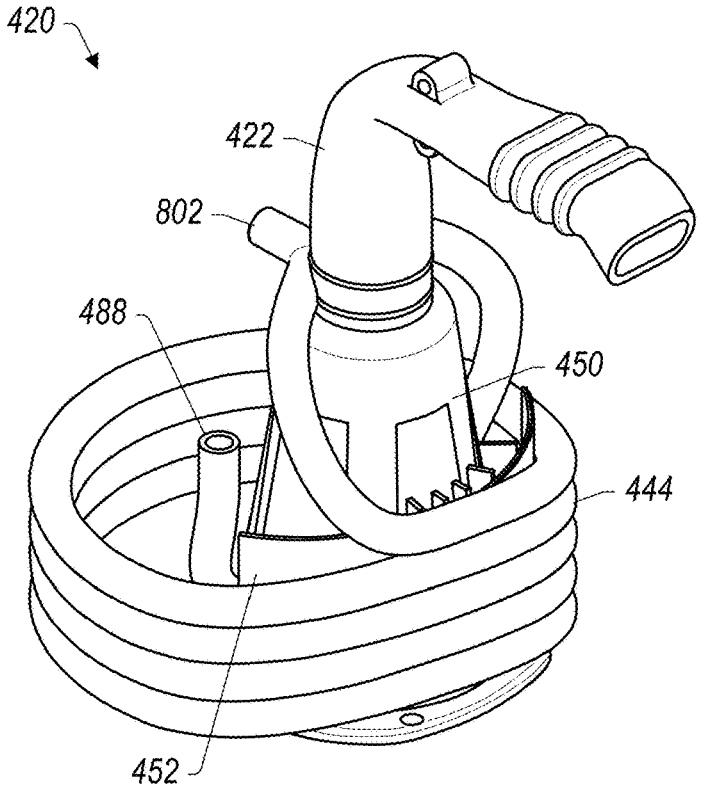
FIGS. 8A and 8B are various views of the auger subassembly of FIG. 4 in accordance with various embodiments.
Figure 8B:
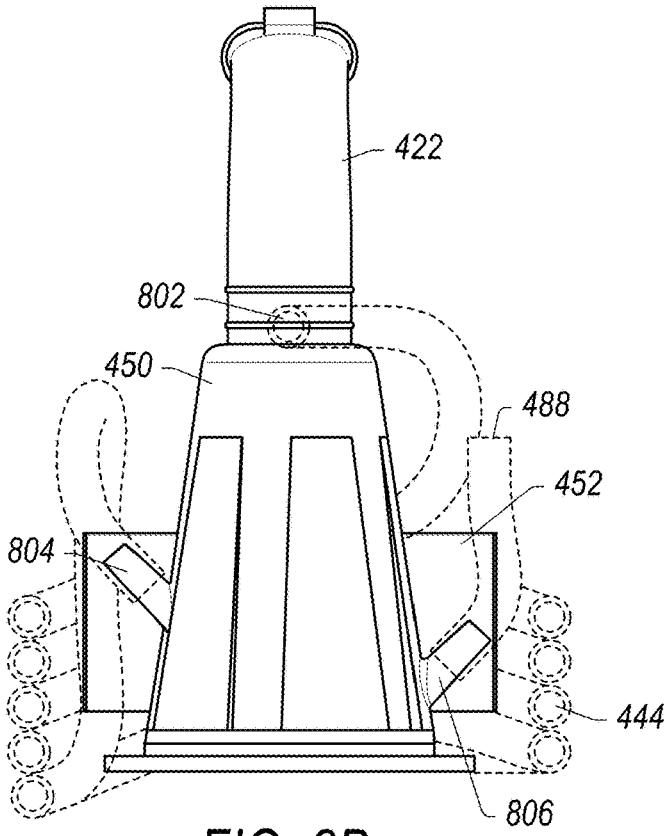

Referring now to FIGS. 8A and 8B, respective perspective and partially transparent rear views of a subassembly 800 of auger tubing 444, auger chamber 450, heating element 452, and lather tube 422 are illustrated. As shown in FIGS. 8A and 8B, auger tubing 444 is coiled around auger chamber 450 with heating element 452 disposed between auger tubing 444 and auger chamber 450. Liquid 314 is pumped into auger tubing 444 (e.g., by pump subassembly 442) through liquid inlet 802. Liquid 314 flows through auger tubing 444 (being warmed by heating element 452) and into auger chamber 450 via auger chamber liquid inlet 804. Air is pulled into auger chamber 450, via air inlet 488 through auger chamber air inlet 806, by the rotation of auger 454 within auger chamber 450 and is mixed with liquid 314 to produce lather as discussed herein. Lather is then pushed out of auger chamber 450 and into lather tube 422.

Referring now to FIGS. 9A and 9B, respective side and rear perspective views of a subassembly 900 of an alternative auger chamber 950, heating element 452, and lather tube 422 is illustrated. In the embodiment shown in FIGS. 9A and 9B, subassembly 900 differs from subassembly 800 (shown in FIGS. 8A and 8B) in that auger tubing 444 and bracket 446 have been removed and various components have modified configurations. Subassembly 900 includes alternative auger chamber 950; an alternative pump subassembly 942; tubes 910, 912, and 914; and alternative bracket 966. In contrast to auger chamber 450, alternative auger chamber 950 includes a single auger chamber inlet 902 into which a mixture of air and liquid 314 flows into alternative auger chamber 950 to be mixed into lather as discussed herein. In various embodiments, alternative auger chamber 950 is made of one or more materials with improved thermal conductance such as cast metal (e.g., cast steel) whereas auger chamber 450 may be made of plastic or other less thermally conductive materials. Thus, whereas heating element 452 of subassembly 800 was configured to heat liquid 314 in auger tubing 444 to keep an amount of liquid 314 at dispensing temperature between uses as discussed herein, the improved thermal conductance of alternative auger chamber 950 facilitates heating such that a smaller amount of liquid 314 is maintained at dispensing temperature (e.g., liquid that remains in alternative auger chamber 950) and liquid that flows into alternative auger chamber 950 during the next dispensing cycle is heated more quickly. In various embodiments, heating element 452 is secured to alternative auger chamber 950 by bracket 952.

In contrast to subassembly 800, air and liquid 314 flows in subassembly 900 are different. As discussed herein, a mixture of air and liquid 314 flows into single auger chamber inlet 902 (e.g., in contrast to auger chamber 450 which has separate inlets for both in auger chamber air inlet 806 and auger chamber liquid inlet 804, respectively). Alternative pump subassembly 942 draws liquid 314 from pod subassembly 200 through a first needle 443 (labeled 443A in FIGS. 9A and 9B). Liquid 314 flows through first needle 443A into alternative pump subassembly 942 through tube 914. Within alternative pump subassembly 942, liquid 314 mixes with air that flows into alternative pump subassembly 942 through inlet 904. The mixture of air and liquid 314 then flows through tube 912 into single auger chamber inlet 902. Air is permitted flow into pod subassembly 200 through a second needle 443 (labeled 443B in FIGS. 9A and 9B), which receives air via tube 910. In various embodiments, tube 910 includes a one-way valve 918 and an air inlet 916. In various embodiments, air flows into tube 910 via air inlet 916 and one-way valve 918 as a result of suction from alternative pump subassembly 942, but one-way valve 918 prevents liquid 314 from flowing out of pod subassembly 200 and then through air inlet 916. Subassembly 900 is secured using alternative bracket 966, which is configured to support alternative pump subassembly 942, bracket 952, and alternative auger chamber 950 and to secure air inlet 916 at the far end of tube 910. Various other components discussed herein may be slightly modified to interface with subassembly 900, but otherwise are configured to perform the same functions discussed herein. In particular, auger 454 and lather tube 422 may have the same configuration for both subassembly 800 and subassembly 900 in various embodiments.

Figure 10:
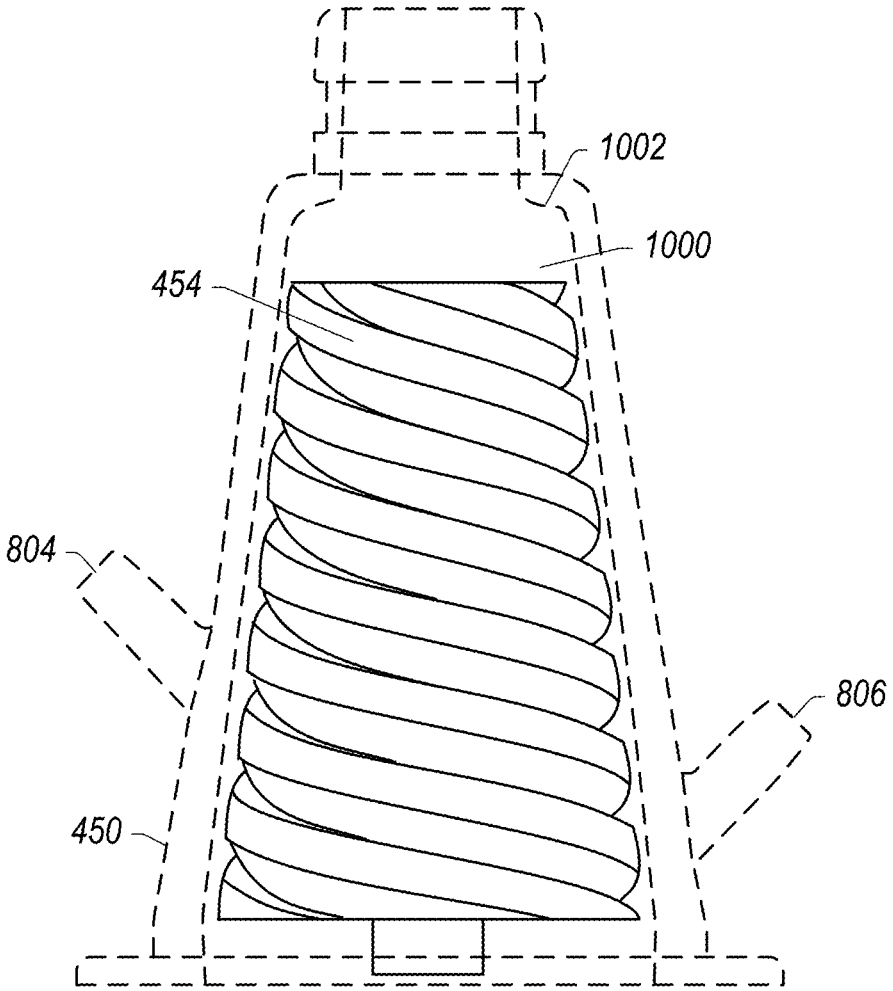
FIG. 10 is a partially transparent view of the auger chamber and auger of FIG. 4 in accordance with various embodiments.

Referring now to FIG. 10, a partially transparent view of the auger chamber 450 and auger 454 is shown. As shown in FIG. 10, auger chamber air inlet 806 is disposed lower on auger chamber 450 than auger chamber liquid inlet 804. As auger 454 rotates, the air is mixed into liquid 314, producing lather. As auger 454 continues to rotate, the lather is pushed up toward the top of auger chamber 450 and out of the top of auger chamber 450. As shown in FIG. 10, auger chamber 450 includes a small cavity 1000 above auger 454, and a neck 1002 which compresses the lather into lather tube 422. As discussed herein, the function of alternative auger chamber 950 and auger 454 is similar to the embodiment shown in FIG. 10, except that rather than flowing in through separate inlets, a mixture of air and liquid 314 flows in though single auger chamber inlet 902 (which is positioned at approximately the same location as auger chamber air inlet 806 shown in FIG. 10), and the rotation of auger 454 aerates the mixture of air and liquid 314 into lather.

Figure 11:
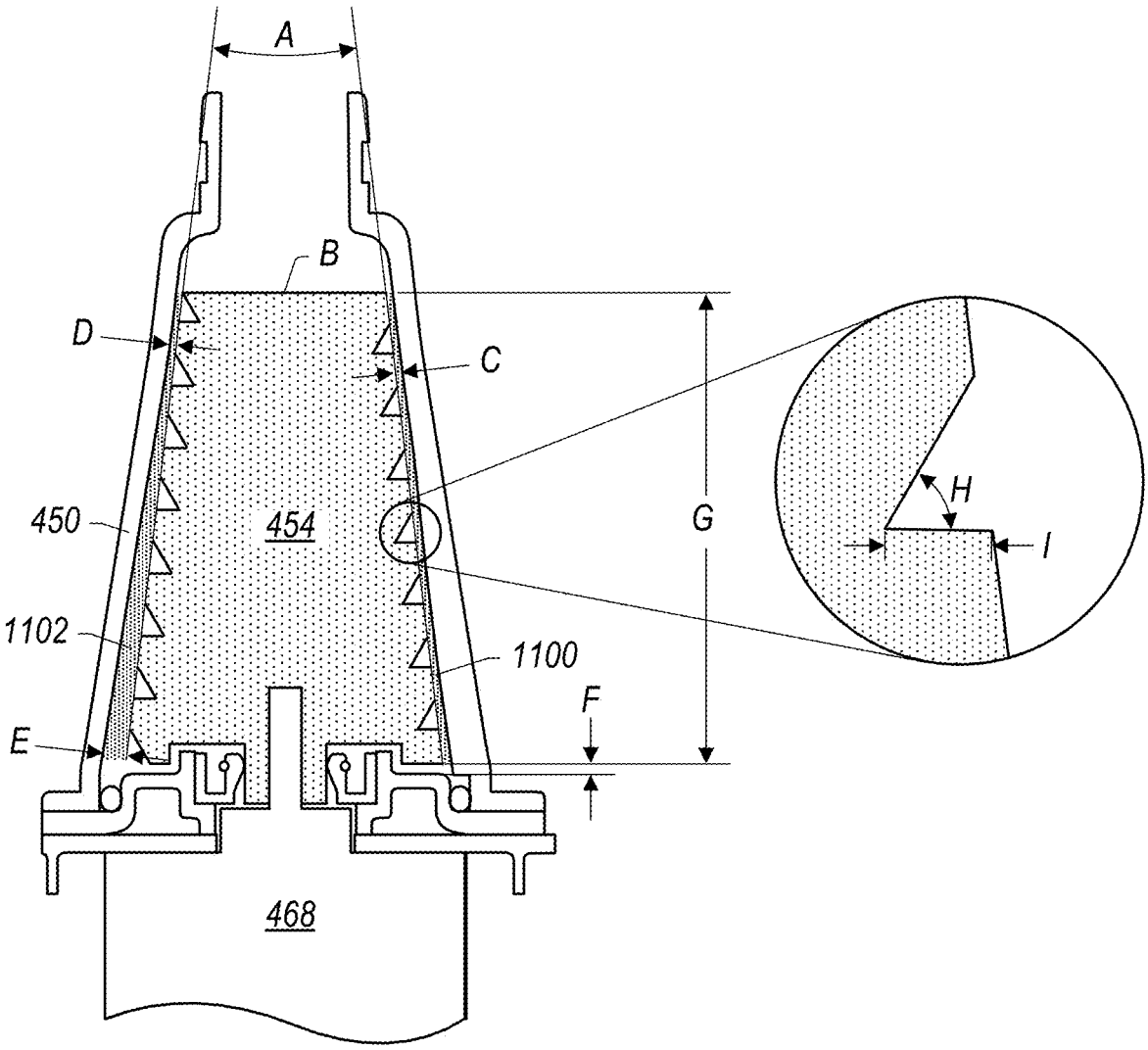
FIG. 11 is a cutaway sideview of the auger subassembly of FIG. 4 in accordance with various embodiments.

Referring now to FIG. 11, an embodiment of auger 454 is illustrated. In the embodiment shown in FIG. 11, auger 454 tapers at an angle A of 13.8 degrees with a height G of 47 mm. In other embodiments, angle A may fall within the range of 8 to 18 degrees. Generally speaking, for a given lather consistency, the auger taper relates to the overall height of the auger; smaller taper angles will generally require taller augers to maintain the same lather consistency. The embodiment of auger 454 shown in FIG. 11 has a top diameter B of about 20 mm (although other diameters are possible). In some embodiments, auger chamber 450/alternative auger chamber 950 will have peaks and valleys along its inner surface in order to help shear the lather. FIG. 11 illustrates clearances 1100 and 1102 between auger 454 and auger chamber 450/alternative auger chamber 950 for the chamber peaks and valleys, respectively. In the illustrated embodiment, the clearance 1100 to chamber peaks labeled C is about 0.75 mm, although in other embodiments C could fall within a range of 0.5 mm to 1.5 mm. In the illustrated embodiment, the clearance 1102 to chamber valleys varies from about 2.3 mm labeled E at the bottom of auger 454 to 0.75 mm labeled D at the top of auger 454, although in other embodiments these E and D could vary by 1-2 mm. In the illustrated embodiment, auger 454 has a 1 mm clearance labeled F above the floor of auger chamber 450/alternative auger chamber 950. Reducing this clearance helps to reduce the overall height of the auger assembly and the dispenser as a whole, although other clearances could be employed. As shown in FIG. 11, the thread profile of auger 454 is described by a 60-degree (labeled H) triangle having a horizontal base that cuts 3 mm (labeled I) into auger 454, with a thread pitch of 18.75 mm. Other embodiments may have thread pitches in the range of 16-19 mm. Other thread profiles are also possible and contemplated.

Referring now to FIG. 12, a graph 1200 illustrates power usage over time of various components of hot lather dispenser 100 in accordance with various embodiments. In particular, graph 1200 includes respective plots 1202, 1204, and 1206 illustrating power usage by heating element 452, auger motor 468, and pump subassembly 442/alternative pump subassembly 942 from time A through time G. At time A, a user depresses trigger subassembly 428, turning on a switch on printed circuit board assembly 436. As a result, the power usage by heating element 452 increases from a lower level (at which the temperature of liquid 314 within auger tubing 444 or alternative auger chamber 950 is maintained at a dispensing temperature (e.g., 120° F.)) to a higher level (to heat liquid 314 pulled into auger tubing 444/alternative auger chamber 950 that was not previously heated). Additionally, as a result of trigger subassembly 428 being depressed, auger motor 468 starts to be gradually activated. At time B (0.5 seconds after A), as the user continues to depress trigger subassembly 428, power usage of heating element 452 has risen to the higher level, and the gradual activation of auger motor 468 continues. At time C (0.5 seconds after B and 1.0 seconds after A), auger motor 468 has been fully activated and is rotating auger 454 to generated lather from heated liquid 314. Additionally, at time C, pump subassembly 442/alternative pump subassembly 942 is activated to begin pulling additional liquid 314 from pod subassembly 200. As the user continues to depress trigger subassembly 428, heating element 452 is kept the higher level, auger motor 468 continues to rotate, and pump subassembly 442/alternative pump subassembly 942 continues to draw liquid 314 from pod subassembly 200. When the user releases trigger subassembly 428 (at time D, 5.0 seconds after time A although the user could depress trigger subassembly 428 for longer or shorter amounts of time), the switch on printed circuit board assembly 436 turns off. As a result, pump subassembly 442/alternative pump subassembly 942 is deactivated. After pump subassembly 442/alternative pump subassembly 942 is turned off, auger motor 468 is deactivated (at time E, 0.5 seconds after time D). For a period of time after the user releases trigger subassembly 428, heating element 452 remains at the higher level (e.g., until time F, 4.5 second after time D) until dropping to the lower level (at time G, 5.0 seconds after time D). This may improve performance when a user successively activates trigger subassembly 428 multiple times turning a relatively short interval by ensuring that additional warm liquid 314 is available to be aerated into lather. In various embodiments, the amount of time that heating element 452 remains at the high level is user configurable (e.g., from between 5 seconds and 50 seconds). It will be understood that the timeline shown in FIG. 12 merely illustrates a particular configuration. In various embodiments, the amount of time between times A-G varies.

Digital temperature control may be employed to ensure that lather is dispensed at the expected temperature. In various embodiments, temperature of lather dispensed by dispenser 100 is user-selectable (e.g., by adjusting how much power is supplied to heating element 452). User selection may be made in any of a number of ways including one or more buttons, dials, switches, or other controls on dispenser 100 or by communication with an exterior device (e.g., via wireless communication with a smart phone). Similarly, the dispensing speed of lather may be likewise set by a user (e.g., by adjusting one or more of a flow rate of liquid 314 into the auger chamber 450/alternative auger chamber 950 or rotational speed of auger 454). In some embodiments, the dispensing speed of lather is controlled by the degree to which trigger subassembly 428 is depressed by the user (e.g., pushing the trigger subassembly 428 only slightly results in relatively slower lather dispensing speed, pushing the trigger subassembly 428 down to the maximum extent results in maximum dispensing speed). By maintaining the system at an intermediate temperature between ambient and dispensing temperature when not in use, the dispenser is capable of providing hot lather without a lengthy warmup time, while at the same time reducing power consumption relative to an implementation in which the system is constantly maintained at the dispensing temperature. Additionally, as noted above, the use of a low-voltage supply (e.g., 12V) reduces safety hazards relative to devices using wall current. In some embodiments, the dispensing temperature and/or the consistency of dispensed lather may be user-selectable, e.g., via buttons on the dispenser or via a wireless interface (e.g., a Bluetooth or other interface with a wireless device such as a smartphone hosting an application).

Although specific embodiments have been described above, these embodiments are not intended to limit the scope of the present disclosure, even where only a single embodiment is described with respect to a particular feature. Examples of features provided in the disclosure are intended to be illustrative rather than restrictive unless stated otherwise. The above description is intended to cover such alternatives, modifications, and equivalents as would be apparent to a person skilled in the art having the benefit of this disclosure. Where particular measurements are given, it is understood that these measurements are subject to ordinary manufacturing tolerances and various embodiments can encompass any variations within such tolerances.

The scope of the present disclosure includes any feature or combination of features disclosed herein (either explicitly or implicitly), or any generalization thereof, whether or not it mitigates any or all of the problems addressed herein. Various advantages of the present disclosure have been described herein, but embodiments may provide some, all, or none of such advantages, or may provide other advantages.

What is claimed is:

1. A hot lather dispenser, comprising:

a compartment configured to receive a removable pod;

a pump configured to receive liquid from the removable pod during operation;

a heater configured to heat the liquid received via the pump;

an auger configured to receive liquid from the pump and to combine the liquid with air to generate lather, wherein the auger is disposed with an auger chamber;

tubing interconnecting the pump and the auger chamber, wherein the tubing is coiled around the auger chamber; and a nozzle configured to dispense lather produced by the auger for use.

2. The hot lather dispenser of claim 1, wherein the compartment is arranged vertically above the pump, and wherein the nozzle is arranged vertically above the auger.

3. The hot lather dispenser of claim 1, further comprising a removable, transparent pod cover that permits the pod to be viewed when inserted into the compartment.

4. The hot lather dispenser of claim 1, wherein the auger is vertically oriented.

5. The hot lather dispenser of claim 4, wherein the auger is disposed with an auger chamber, wherein the vertical orientation of the auger permits un-foamed liquid to drain back down within the auger chamber to be re-foamed into lather.

6. The hot lather dispenser of claim 1, further comprising a cylinder within which the pump, heater, and auger are disposed.

7. The hot lather dispenser of claim 1, wherein the heater is interposed between the tubing and the auger chamber.

8. The hot lather dispenser of claim 1, wherein during a period when power is applied to the hot lather dispenser but the hot lather dispenser is not dispensing lather, the heater is configured to operate at a standby power level to maintain the liquid within the tubing coiled around the auger chamber at a dispensing temperature without necessarily maintaining liquid outside the tubing at the dispensing temperature.

9. The hot lather dispenser of claim 8, wherein based on activation of the hot lather dispenser to dispense lather, the heater is configured to operate at a dispensing power level greater than the standby power level.

10. The hot lather dispenser of claim 8, wherein the dispensing temperature is user-selectable.

11. The hot lather dispenser of claim 1, further comprising a trigger assembly configured to cause lather to be dispensed based on activation of the trigger assembly.

12. The hot lather dispenser of claim 11, wherein the trigger assembly is further configured to cause a supply to the nozzle to be physically clamped closed based on inactivation of the trigger assembly.

13. The hot lather dispenser of claim 1, wherein a consistency of the dispensed lather is user-selectable.

14. The hot lather dispenser of claim 13, wherein the auger is disposed with an auger chamber, wherein the consistency of the dispensed lather is based on adjusting one or more of a flow rate of liquid into the auger chamber or a rotational speed of the auger.

15. The hot lather dispenser of claim 1, further comprising an air check valve coupled to the pump that is configured to prevent evaporation from a reservoir associated with the pump.

16. The hot lather dispenser of claim 1, wherein the auger is disposed with an auger chamber, the hot lather dispenser further comprising:

an air check valve coupled to the auger chamber that is configured to prevent evaporation from the auger chamber.

17. The hot lather dispenser of claim 1, wherein the auger is disposed with an auger chamber, wherein the auger chamber includes an inner chamber having peaks and valleys.

18. The hot lather dispenser of claim 1, wherein the auger includes threads having a profile described by a 60-degree triangle having a horizontal base cutting into the auger by 3 mm.

* * * * *